US006482037B1

(12) United States Patent
Zhu et al.

(10) Patent No.: US 6,482,037 B1
(45) Date of Patent: Nov. 19, 2002

(54) RECEPTACLE CONNECTOR WITH GROUNDING TABS

(75) Inventors: ZiQiang Zhu, Kunsan (CN); Jinkui Hu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/033,654

(22) Filed: Dec. 27, 2001

(51) Int. Cl.[7] ..... H01R 13/648
(52) U.S. Cl. ..... 439/607; 439/108
(58) Field of Search ..... 439/607, 609, 439/567, 570, 571, 572, 108, 92

(56) References Cited

U.S. PATENT DOCUMENTS 5,921,811 A * 7/1999 Hsu ..... 439/567
6,155,878 A * 12/2000 Chen ..... 439/607
6,250,935 B1 * 6/2001 Mochizuki et al. ..... 439/108
6,273,757 B1 * 8/2001 David et al. ..... 439/607
6,354,875 B1 * 3/2002 Wu ..... 439/607
6,361,332 B1 * 3/2002 Froude et al. ..... 439/570
6,364,707 B1 * 4/2002 Wang ..... 439/607
6,109,968 A1 * 8/2002 Wang ..... 439/567

* cited by examiner

*Primary Examiner*—Gary Paumen
(74) *Attorney, Agent, or Firm*—Wei Te Chung

(57) ABSTRACT

A receptacle connector (100) comprises: an insulative housing (10) comprising a front plug portion (12), a rear base portion (14) defining a slot in a rear end proximate to one side thereof, and a plurality of receiving passageways (16); a plurality of terminals (20) received in the receiving passageways; an inner shell (104) enclosing the plug portion and having one side wall (105) extending into the slot; an outer shield (110) enclosing both the inner shell and the insulative housing; and a grounding tab (30) received in the slot and resiliently contacting with the sidewall of the inner shell for grounding.

1 Claim, 5 Drawing Sheets

RECEPTACLE CONNECTOR WITH GROUNDING TABS

BACKGROUND OF THE INVENTION

1. Field of the Invention

The present invention relates to a receptacle connector, and particularly to a receptacle connector with grounding tabs which can ensure reliable grounding and electromagnetic interference (EMI) shielding.

2. Description of Related Art

It is known that, when connectors are used in high speed data transmission applications, the amount of electromagnetic or radio frequency interference increases. One solution to this problem has been to use an inner shell and an outer shield. Usually the outer shield has a pair of solder pads to be soldered on a printed circuit board for grounding. However, in some applications, the inner shell is required to be grounded for enhanced EMI shielding. The inner shell is received in the outer shield and is partly embedded in the insulative housing, so it is difficult to connect the inner shell to grounding traces of the circuit board. An existing inner shell has been designed to have integrated grounding tabs for electrical connection with the grounding traces of the circuit board. However, each grounding tab is connected with the inner shell via a narrow connecting portion therebetween, which has a weak mechanical strength. When a mating plug connector is inserted into or pulled out from the receptacle connector, inappropriate inserting and pulling forces may cause the connecting portion to break, whereby the grounding tab is ineffective. Furthermore, assembly of the integrally formed inner shell to the insulative housing becomes difficult.

Therefore, a receptacle connector with individually manufactured grounding means is desired.

SUMMARY OF THE INVENTION

Accordingly, the object of the present invention is to provide a receptacle connector having a pair of grounding tabs resiliently engaged with an inner shell for grounding and for enhanced EMI shielding.

In order to achieve the object set forth, a receptacle connector in accordance with the present invention comprises an insulative housing comprising a front plug portion, and a rear base portion defining a pair of slots in a rear end thereof, a plurality of terminals received in the insulative housing, an inner shell enclosing the plug portion and having a pair of side walls partially received in the slots, an outer shield enclosing both the inner shell and the insulative housing, and a pair of grounding tabs resiliently engaged with the side walls of the inner shell in the slots for grounding. Thus, the inner shell is grounded so as to ensure an enhanced EMI shielding of the terminals.

Other objects, advantages and novel features of the invention will become more apparent from the following detailed description when taken in conjunction with the accompanying drawings.

DETAILED DESCRIPTION OF THE INVENTION

Figure 1:
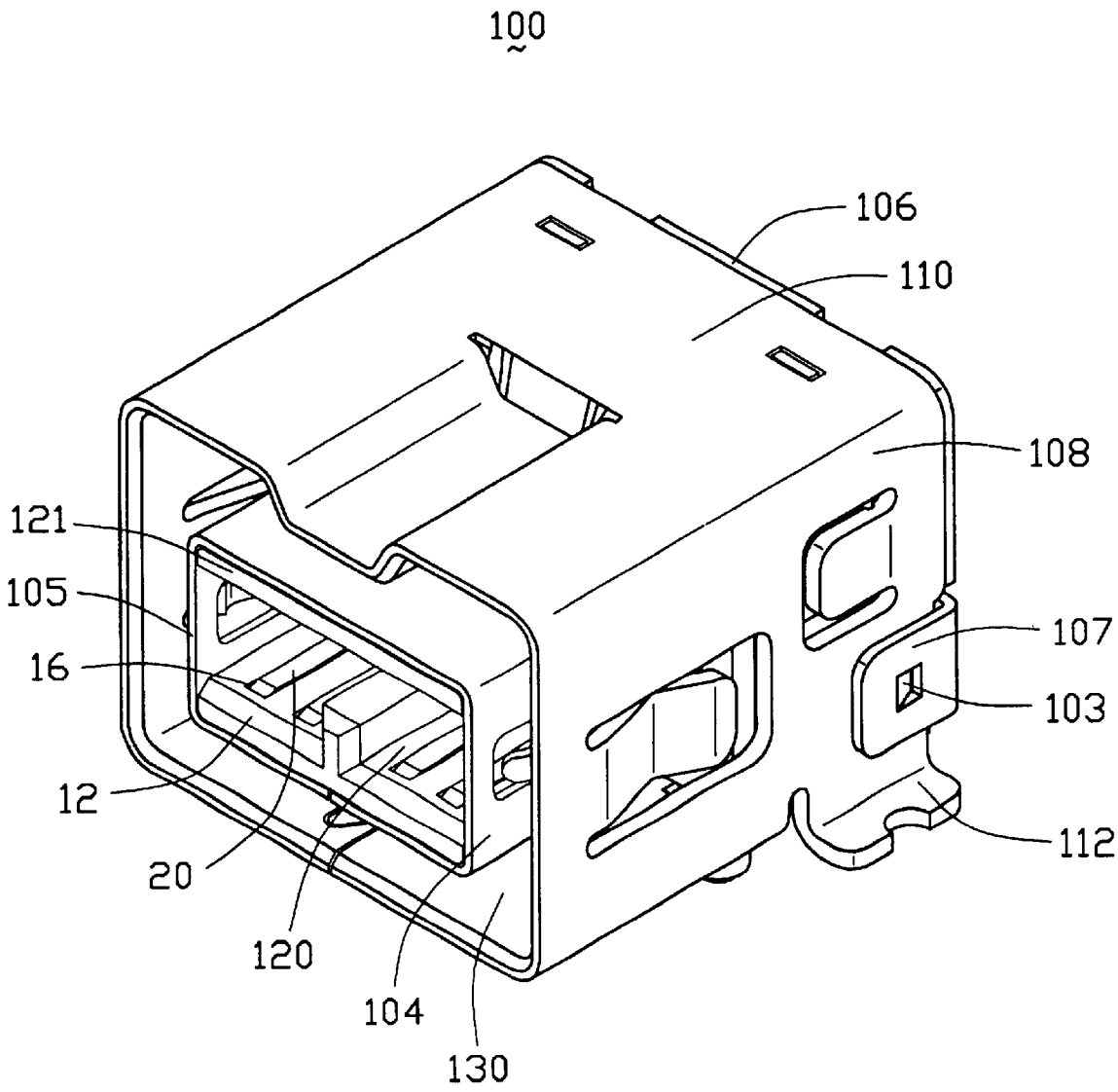
FIG. 1 is a perspective view of a receptacle connector in accordance with the present invention.
Figure 2:
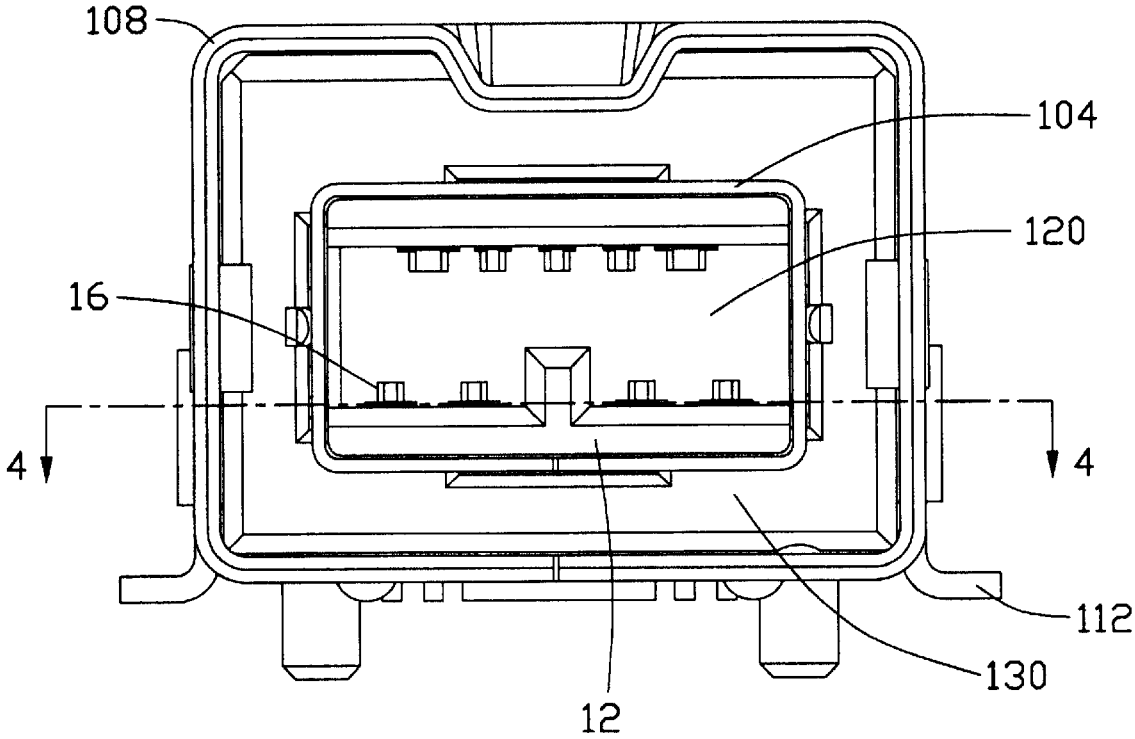
FIG. 2 is a front view of the receptacle connector in accordance with the present invention.
Figure 3:
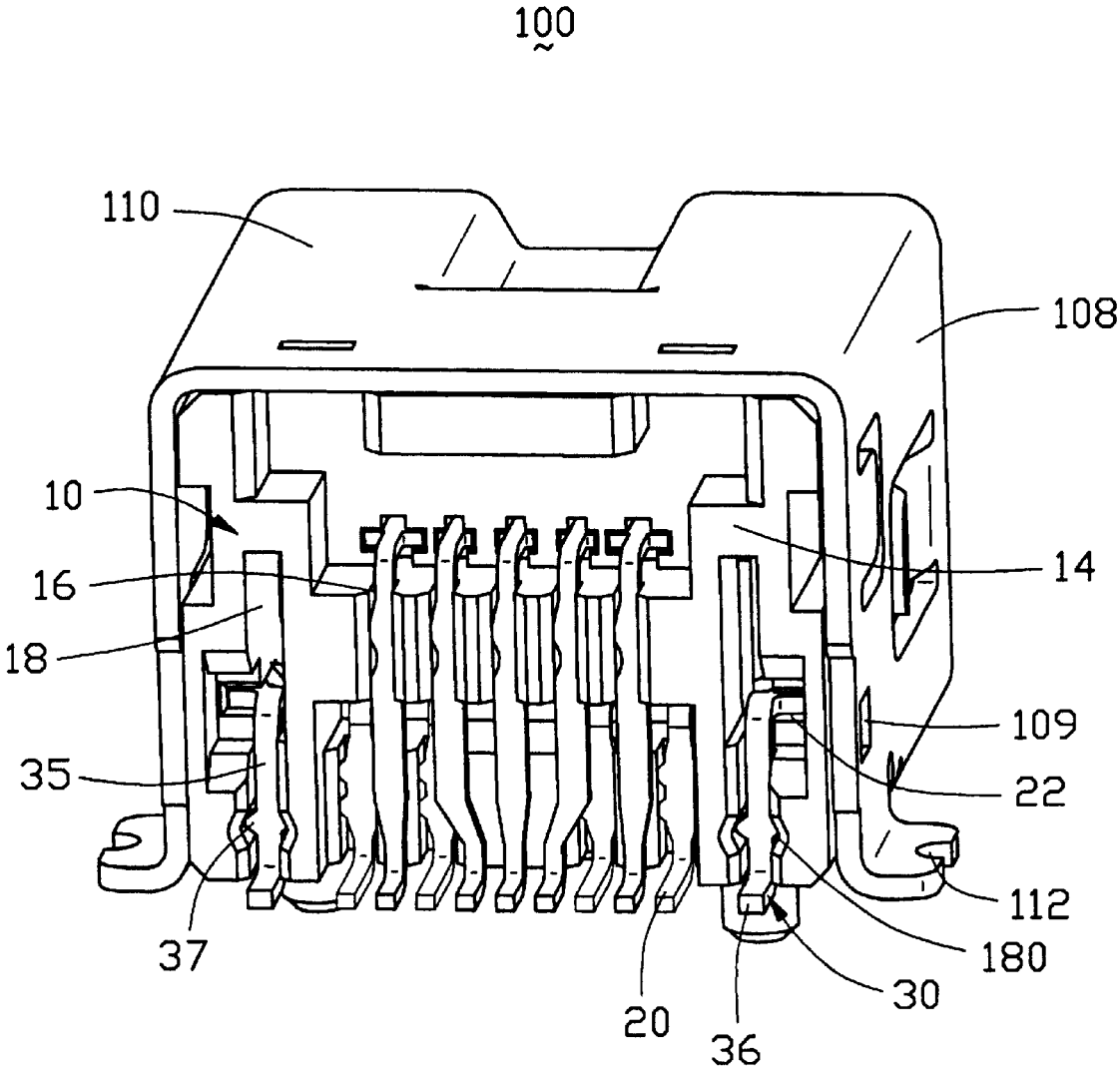
FIG. 3 is a back view of the receptacle connector in accordance with the present invention, with a rear cover of an inner shell being removed for clarity.

FIGS. 1–4 illustrate a receptacle connector 100 of the present invention. The receptacle connector 100 comprises an insulative housing 10, a plurality of terminals 20 received in the insulative housing 10, an inner shell 104, an outer shield 110 and a pair of grounding tabs 30.

The housing 10 comprises a front plug portion 12, a rear base portion 14, and a plurality of receiving passageways 16 defined therethrough. The plug portion 12 extends forwardly from the base portion 14 and comprises a pair of upper and lower tongues 121. Front portions of the receiving passageways 16 are defined in the upper and lower tongues 121 in an upper array and a lower array for receiving mating portions of the terminals 20. The base portion 14 defines rear portions of the receiving passageways 16, and a pair of opposite slots in a rear end thereof proximate to opposite sides thereof. Each slot includes a vertical portion 18 and a horizontal portion 22 communicating with the vertical portion 18. An enlarged recess 180 is formed at a lower end of each vertical portion 18.

The conductive inner shell 104 encloses the plug portion 12 for receiving a plug portion of a mating plug connector (not shown). The plug portion 12 and the inner shell 104 are adapted to be received in a cavity of the mating plug connector when the receptacle connector 100 mates with the mating plug connector. Each side wall 105 of the inner shell 104 extends rearwards into the corresponding vertical portion 18 of the slot, whereby a cavity 120 is defined between opposite side walls 105 of the inner shell 104 and upper and lower tongues 121 of the insulative housing 10.

The conductive outer shield 110 comprises a metal frame 108 enclosing both the insulative housing 10 and the inner shell 104, and a rear cover 106 covering the rear end of the base portion 14. A pair of solder pads 112 are integrally formed on opposite sides of the frame 108 for mounting the receptacle connector 100 on a printed circuit board (PCB) (not shown). A pair of retention tabs 107 are provided on opposite sides of the rear cover 106 and each has a tang 103 secured in a corresponding hole 109 defined in the frame 108. An annular receiving space 130 is defined between the outer shield 110 and the inner shell 104 for receiving an outer portion of a housing of the mating plug connector (not shown).

Figure 4:
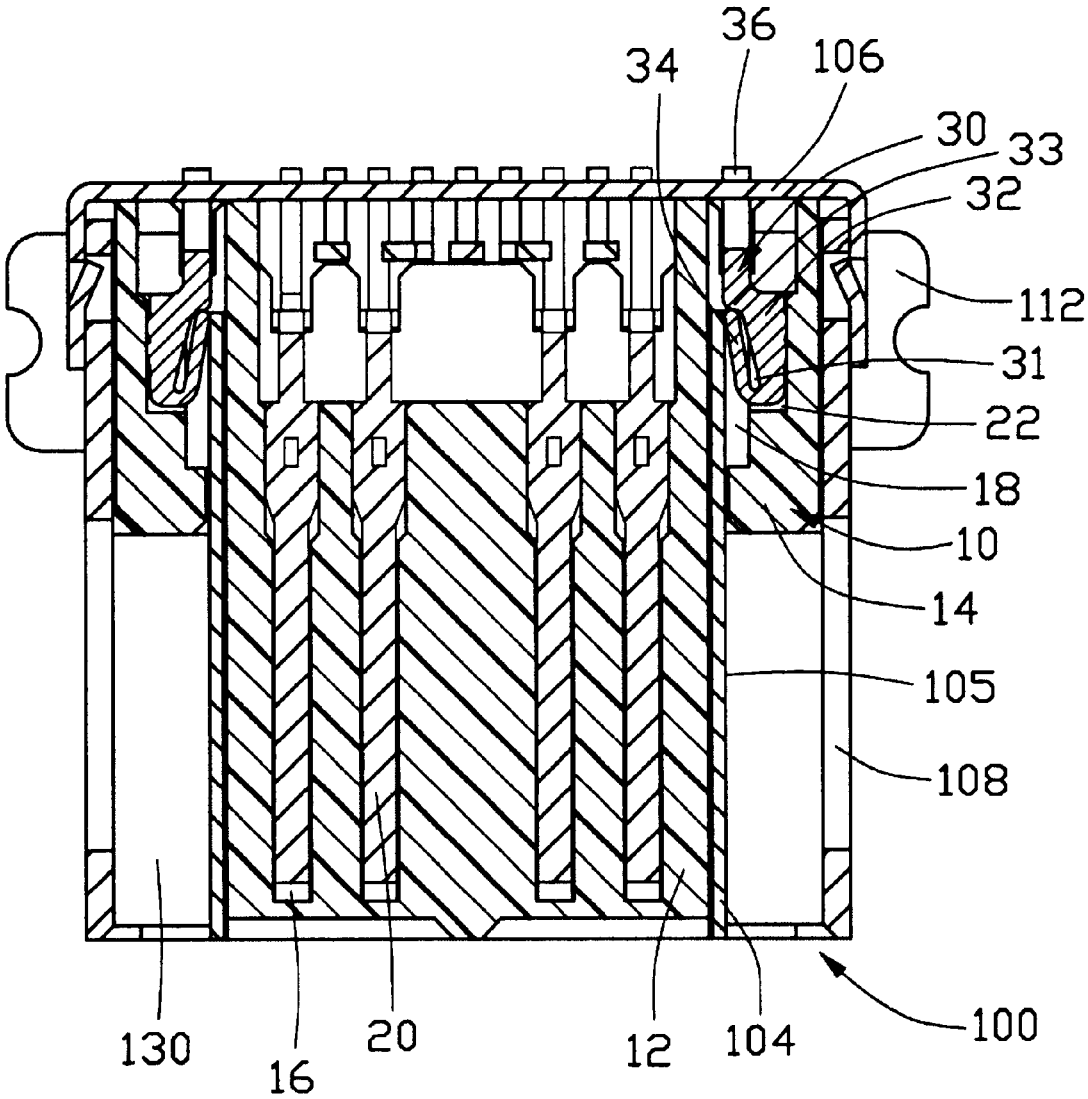
FIG. 4 is a cross-sectional view of the receptacle connector taken along line 4—4 in FIG. 2.
Figure 5:
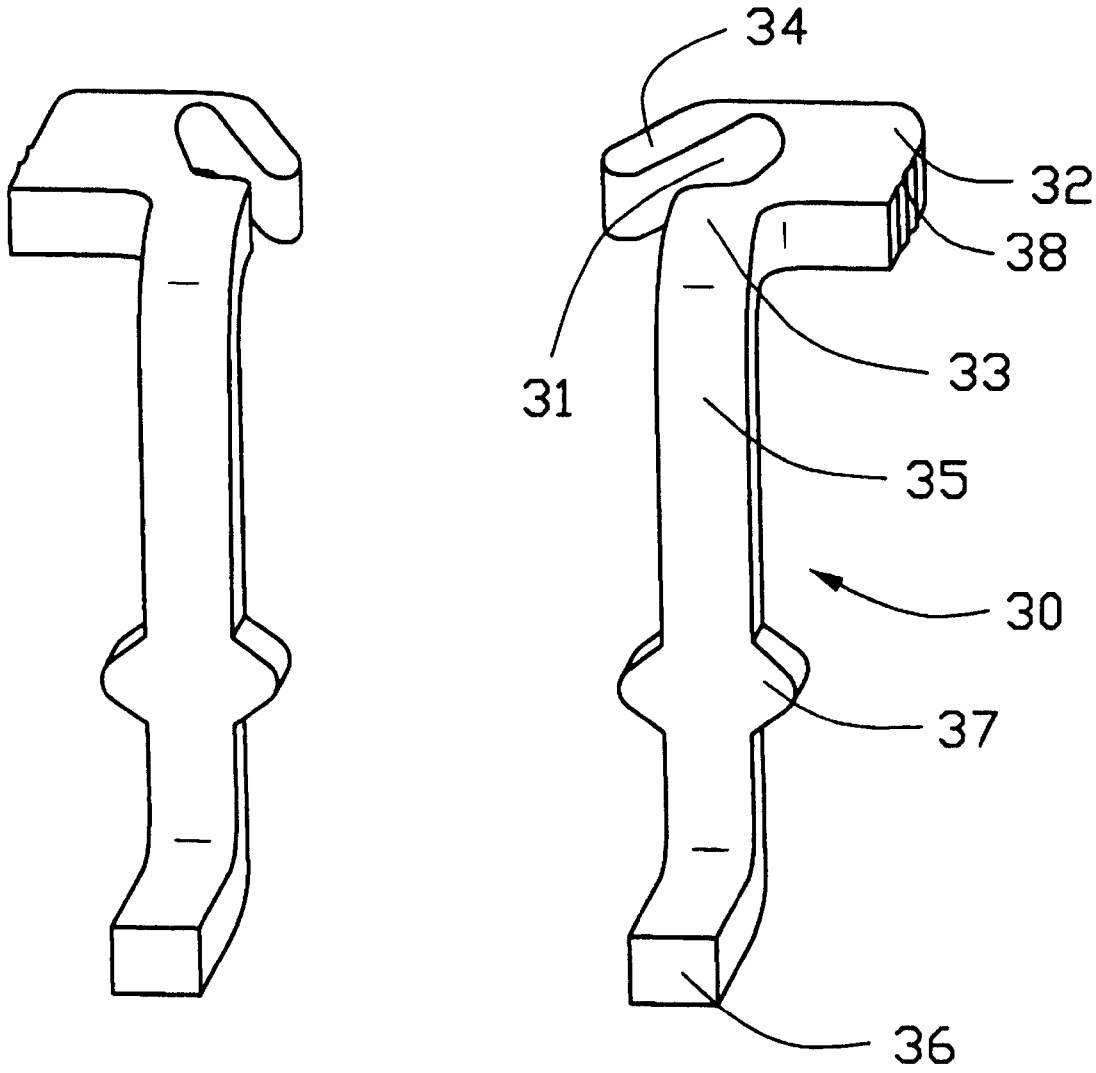
FIG. 5 is an enlarged perspective view of a pair of grounding tabs of the receptacle connector of the present invention.

Referring to FIGS. 4 and 5, the grounding tab 30 of the present invention comprises a retention portion 32 received in the horizontal portion 22 of the slot and comprising a pair of barbs 38 at an outer edge thereof for engaging with an inner sidewall of the horizontal portion 22, an arm 34 obliquely extending from an inner edge of the retention portion 32 and electrically contacting with the inner shell 104, a bent portion 33 extending from a rear end of the retention portion 32 and having an arc, a vertical portion 35 extending downwardly from a lower end of the bent portion 33, and a tail portion 36 extending perpendicularly from a lower end of vertical portion 35 for linking to the ground. The vertical portion 35 comprises an enlarged section 37. A space 31 is defined between the retention portion 32, the arc portion 33 and the arm 34 to provide the arm 34 with resiliency.

When the grounding tab 30 is assembled to the housing 10, the retention portion 32 is inserted in the horizontal portion 22 with the barbs 38 thereof interferentially engaging with the inner sidewall of the horizontal portion 22, and the arm 34 is compressed and inserted in an upper portion of the vertical portion 18 with the dimension of space 31 being reduced, whereby the retention portion 32 is assembled in the horizontal portion 22 firmly and the arm 34 abut against the bent portion 33 and resiliently contacts an outer surface of the corresponding sidewall 105 of the inner shell 104. The vertical portion 35 extends along the vertical portion 18 of the slot with the enlarged section 37 thereof received in the enlarged recess 180 for retaining the grounding tab 30 in the vertical portion 18. The tail portion 36 is soldered on a ground circuit of a printed circuit board for grounding. The inner shell 104 is thus grounded. The solder pads 112 of the outer shield 110 are also soldered on the printed circuit board for grounding. Thus, both the inner shell 104 and the outer shield 110 are grounded, thereby achieving enhanced EMI shielding.

It should be understood that the above description is only a preferred embodiment illustrating the main concept of the present invention, and some changes may be made to the structure. These changes may comprise adding an additional portion to the grounding tab to contact with the outer shield for grounding. These changes can achieve the same function as the above-mentioned embodiment, and are within the skill of one ordinary artisan.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector for being mounted on a printed circuit board, comprising:

an insulative housing comprising a base portion defining a slot in a rear end thereof, a plug portion forwardly extending from the base portion, and a plurality of receiving passageways defined through the plug portion and the base portion;

a plurality of terminals received in the receiving passageways;

a metal shell enclosing the plug portion and having a sidewall rearwardly extending into the slot; and a grounding tab comprising a retention portion secured in the slot, an arm obliquely extending from the retention portion and resiliently contacting the sidewall of the inner shell, and a tail portion at a lower end thereof for being soldered to a ground circuit of a printed circuit board;

wherein the arm and the retention portion define a space therebetween for providing resiliency;

wherein the slot has a vertical portion receiving the arm of the grounding tab and a horizontal portion receiving the retention portion of the grounding tab;

wherein the retention portion of the grounding tab has at least one barb engaged with an inner sidewall of the horizontal portion of the slot;

wherein the vertical portion of the slot has an enlarged recess, and the grounding tab has an enlarged section proximate to the solder portion and received in the enlarged recess;

further comprising an outer metal shield enclosing both the inner shell and the insulative housing;

wherein the outer shield has a pair of solder pads far grounding;

wherein the outer shield comprises a separate rear cover covering the rear end of the base portion;

wherein the outer shield and the shell define an annular receiving space therebetween.

* * * * *